US009925470B1

(12) United States Patent
Palacio

(10) Patent No.: US 9,925,470 B1
(45) Date of Patent: Mar. 27, 2018

(54) URN HOLDING STUFFED ANIMAL

(71) Applicant: Ceci Palacio, San Diego, CA (US)

(72) Inventor: Ceci Palacio, San Diego, CA (US)

( * ) Notice: Subject to any disclaimer, the term of this patent is extended or adjusted under 35 U.S.C. 154(b) by 0 days.

(21) Appl. No.: 15/832,089

(22) Filed: Dec. 5, 2017

Related U.S. Application Data

(63) Continuation-in-part of application No. 15/581,612, filed on Apr. 28, 2017.

(60) Provisional application No. 62/447,253, filed on Jan. 17, 2017.

(51) Int. Cl.

| | |
|---|---|
| ***A63H 3/00*** | (2006.01) |
| ***A61G 17/08*** | (2006.01) |
| ***A61G 17/007*** | (2006.01) |
| *A63H 3/02* | (2006.01) |

(52) U.S. Cl.
CPC ..... *A63H 3/005* (2013.01); *A61G 17/007* (2013.01); *A61G 17/08* (2013.01); *A63H 3/006* (2013.01); *A63H 3/02* (2013.01)

(58) Field of Classification Search
CPC ..... A63H 3/005; A63H 3/006; A63H 3/02; A61G 17/007; A61G 17/08
USPC ..... 27/1; 446/73
See application file for complete search history.

(56) References Cited

U.S. PATENT DOCUMENTS

| | | | | |
|---|---|---|---|---|
| 5,807,155 | A * | 9/1998 | Divvleeon | A63H 3/003 446/369 |
| D401,347 | S | 11/1998 | Cosentino | |
| 5,944,577 | A | 8/1999 | Yanofsky et al. | |
| 6,023,822 | A * | 2/2000 | Luebke | A61G 17/08 27/1 |
| 6,028,517 | A | 2/2000 | Sansone et al. | |
| 6,755,712 | B2 * | 6/2004 | Morris | A63H 3/005 446/268 |
| 6,785,938 | B1 * | 9/2004 | Johansen, Jr. | A61G 17/08 27/1 |
| 7,308,741 | B1 | 12/2007 | Rydberg | |
| 7,526,844 | B2 * | 5/2009 | Pearce | A61G 17/08 27/1 |
| 7,627,935 | B1 * | 12/2009 | Ostrum | A61G 17/08 27/1 |
| D629,584 | S | 12/2010 | Riehl | |
| 8,152,587 | B1 * | 4/2012 | Brown | A63H 3/02 206/216 |
| 8,613,639 | B2 * | 12/2013 | Hengel | A63H 3/02 446/73 |
| 8,628,371 | B2 * | 1/2014 | D'Alleva | A45C 1/12 434/107 |
| 2002/0100152 | A1 * | 8/2002 | Ortega | A61G 17/08 27/1 |
| 2002/0168919 | A1 | 11/2002 | Perkins | |
| 2006/0059669 | A1 * | 3/2006 | Rose | A61G 17/08 27/1 |
| 2007/0042672 | A1 * | 2/2007 | Tawil | A63H 3/02 446/369 |

(Continued)

FOREIGN PATENT DOCUMENTS

| | | | | |
|---|---|---|---|---|
| CA | 2639274 | A1 * | 3/2010 | A61G 17/08 |

*Primary Examiner* — William Miller
(74) *Attorney, Agent, or Firm* — Law Office of Scott C Harris, Inc

(57) ABSTRACT

An urn holding device comprises a body encasing plush fill and a compartment disposed within in an interior of the body. The compartment has at least one opening in communication with the body. The plush fill surrounds all sides of the urn within the body.

8 Claims, 7 Drawing Sheets

(56) References Cited

U.S. PATENT DOCUMENTS

| | | | | |
|---|---|---|---|---|
| 2007/0232186 | A1 | 10/2007 | Shamah | |
| 2008/0032594 | A1 | 2/2008 | Magener | |
| 2013/0152348 | A1* | 6/2013 | Taylor ..... | A61G 17/08 27/1 |
| 2014/0227933 | A1 | 8/2014 | Bagla | |

* cited by examiner

URN HOLDING STUFFED ANIMAL

The present application is a continuation in part of application Ser. No. 15/581,612, filed Apr. 28, 2017.

This application also claims priority to U.S. Provisional Patent Application No. 62/447,253 filed on Jan. 17, 2017, entitled "Urn holding device".

The entire disclosures of both of which are incorporated by reference herein.

BACKGROUND OF THE INVENTION

When someone dies, the decision must be made to bury or cremate the remains. Due to decreasing space, high cost, and lack of continued connection associated with traditional burials, cremation is increasing as the chosen method for treatment of the remains.

A loved one's ashes (if cremated), are placed in an Urn or ash container. Then the Urn is placed on a fireplace mantel, a shelf, or anywhere in the home.

SUMMARY OF THE INVENTION

The inventor recognizes that during moments of deep sorrow and/or weeping, a grieving party would prefer a friendly soft device that can be hugged and held by the individual(s) who suffered the loss of their loved one.

Based on the foregoing, the inventor recognized a need in the art for a device that allows a person to easily carry these remains in a special user-friendly way.

An embodiment describes a stuffed animal, with a compartment through the center of the stuffed animal. The compartment is located in a way so that one or more urns, typically including ash remains from cremation, can be put into the stuffed animal. Moreover, the stuffed animal is configured in a way to provide plush padding all the way around the urn or urns, so that the urns, usually formed of metal or other hard material, cannot be felt, or minimally felt, through the padding.

In an embodiment, there is padding at all locations between the urn, and the outside of the stuffed animal.

An urn holding device comprises a body encasing plush fill and a cavity disposed within in an interior of the body. That cavity is along the central axis of the body of the stuffed animal. The stuffing in the animal then surrounds the urns in a way such that the urns that are inside of that cavity cannot be felt from any side due to the stuffing and the pillow. The compartment has at least one opening in communication with the body. The plush fill retains the compartment within the body.

In an embodiment, the body further comprises a head having two eyes, a nose, and a mouth positioned on an exterior surface of the head; a pair of legs extending outward from the body; and a pair of arms extending outward from the body, wherein the pair of arms extend outward from a portion of the body between the head and the pair of legs, wherein the head, the pair of arms, and the pair of legs are attached to an exterior surface of the body.

In an embodiment, the body is defined at least two sides and there is an opening at the bottom of the body, extending up through the inner cavity of the body. More specifically, the opening can be at a location starting at approximately the pelvic area and extending towards the tail end in order for opening to be hidden when plush toy is in its "sitting" position In an embodiment, the device further comprises a visual indicator electrically connected to a power source, wherein the visual indicator is triggered by a switch.

In an embodiment, the switch is disposed within the compartment, wherein the switch is triggered by an object placed within the compartment.

The foregoing, and other features and advantages of the invention, will be apparent from the following, more particular description of the preferred embodiments of the invention, the accompanying drawings, and the claims.

BRIEF DESCRIPTION OF THE DRAWINGS

Aspects of the invention are shown in the drawings, in which.

DETAILED DESCRIPTION

Figure 1:
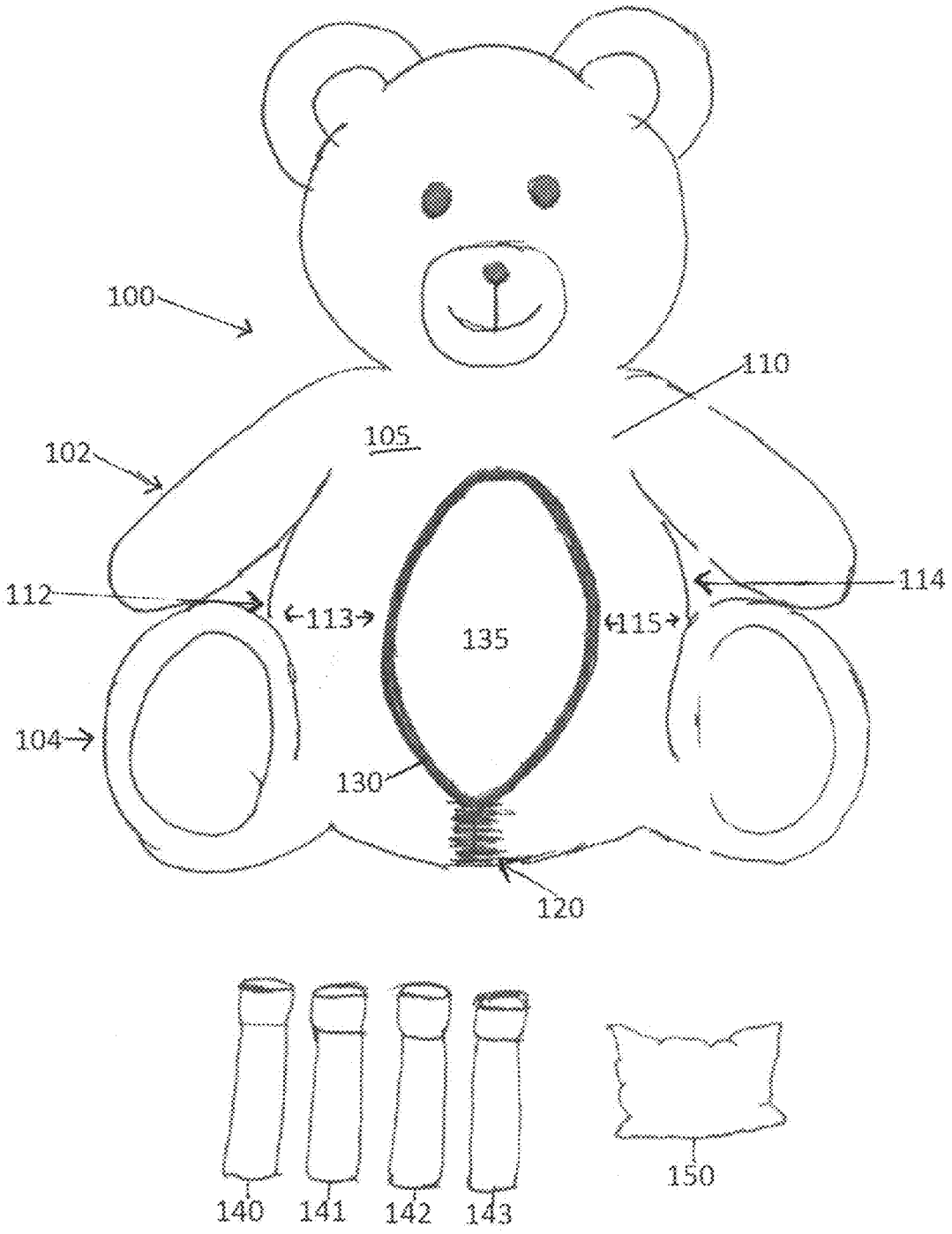
FIG. 1 shows a front view of a stuffed animal which also functions as an urn holding device.

An embodiment is shown in FIGS. 1 through 7A, 7B, and showing the urn holding device is being a stuffed animal in the shape of a teddy bear. In other embodiments, the urn holding device can be a different kind of stuffed animal, and/or any kind of stuffed toys. Preferably the stuffed toy is one with extending arms and legs, to enable the toy to be held by a user. In addition, the stuffed toy can include straps allowing the stuffed toys to be worn as a backpack.

The stuffed animal 100 is shown as a teddy bear with arms 102 that extend away from the main body 110 and legs 104 that also extend away from the main body 110. There is an opening 120 at the bottom of the body, referred to herein as the "tail end", which is sealed by a zipper or Velcro or the like. The opening leads into a central inner cavity 135 which is lined with soft or rigid fabric material 130. The figures show this inner cavity 135 that is actually inside the stuffed animal, and show it as though the plush and the outer skin of the stuffed animal were both transparent.

The central inner cavity 135 is surrounded at all its four sides 113, 115; and 701, 702 with plush material 105 that forms the interior stuffing of the stuffed animal. In an embodiment, the inner cavity is centrally aligned on the inside of the stuffed animal, central between the first side 112 and the second side 114, and central between the front 700 of the stuffed animal 700, and the rear 710 of the stuffed animal 710.

FIG. 1 also shows the urns, 140, 141, 142 and 143. Between one or more urns can be located into the central cavity 135 of the stuffed animal. In addition, the device includes a pillow 150 which is placed under the urns, specifically between the urns and the tail end of the stuffed animal. According to an embodiment, when the pillow is placed under the urns, the urns and cavity pocket are fully separated from the exterior of the stuffed animal by plush material, at all their sides 113, 115, 701, 702 and 150, keeping the cavity centered within the surrounding plush material.

Figure 2:
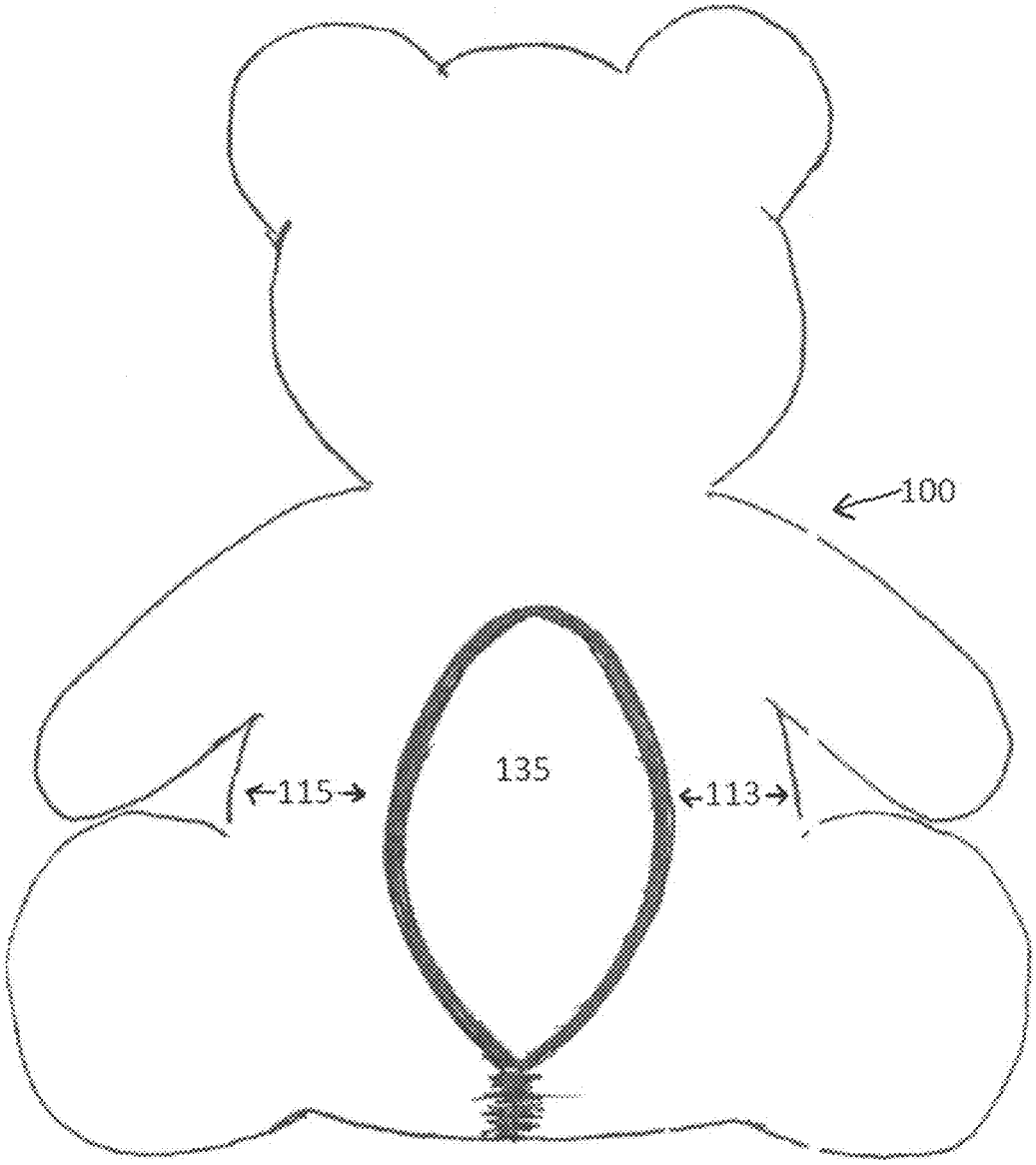
FIG. 2 shows a rear view of the stuffed animal/urn holding device.

FIG. 2 illustrates the stuffed animal with central cavity from the rear.

Figure 3:
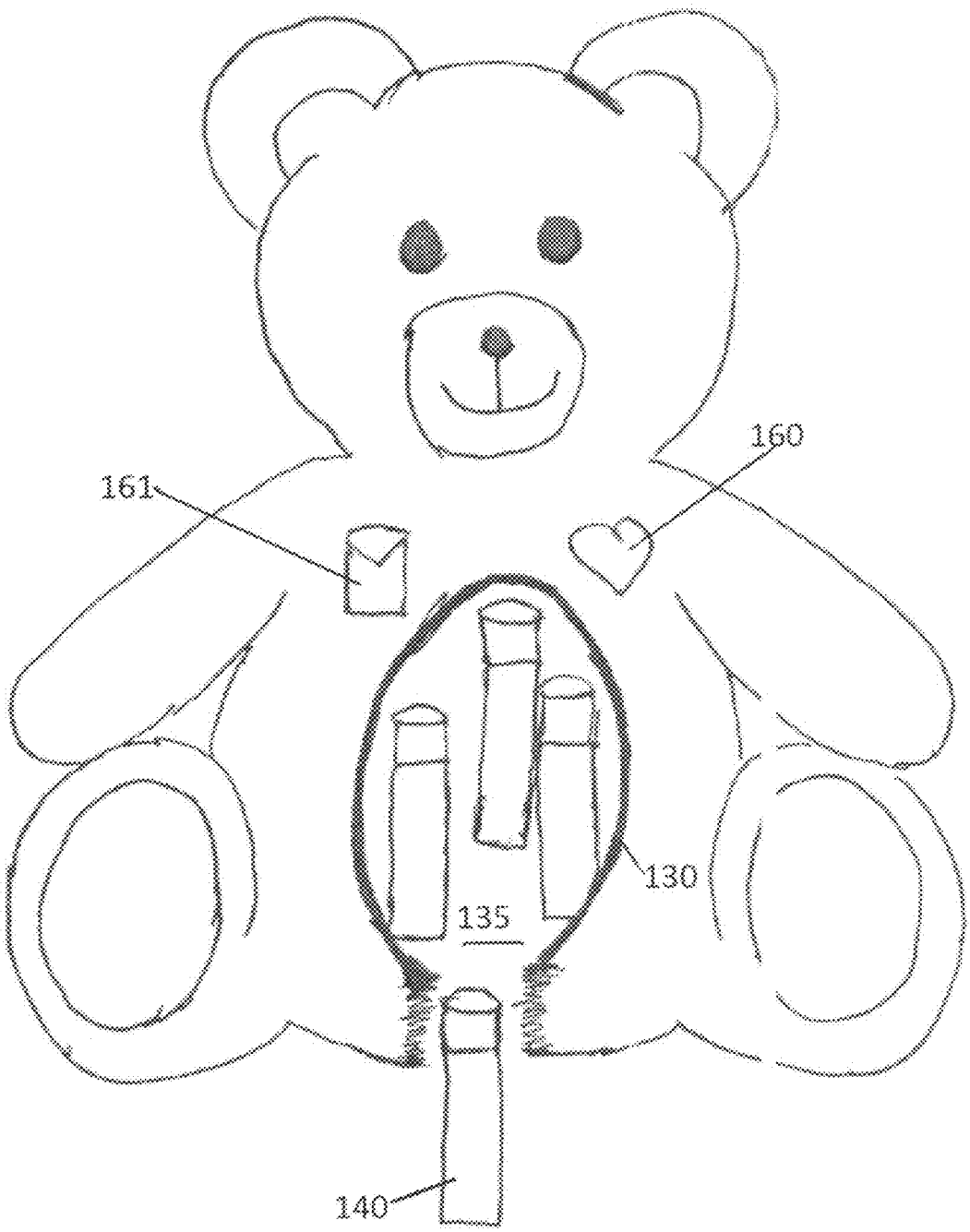
FIG. 3 shows urns placed within the internal central pocket of the urn holding device.
Figure 4:
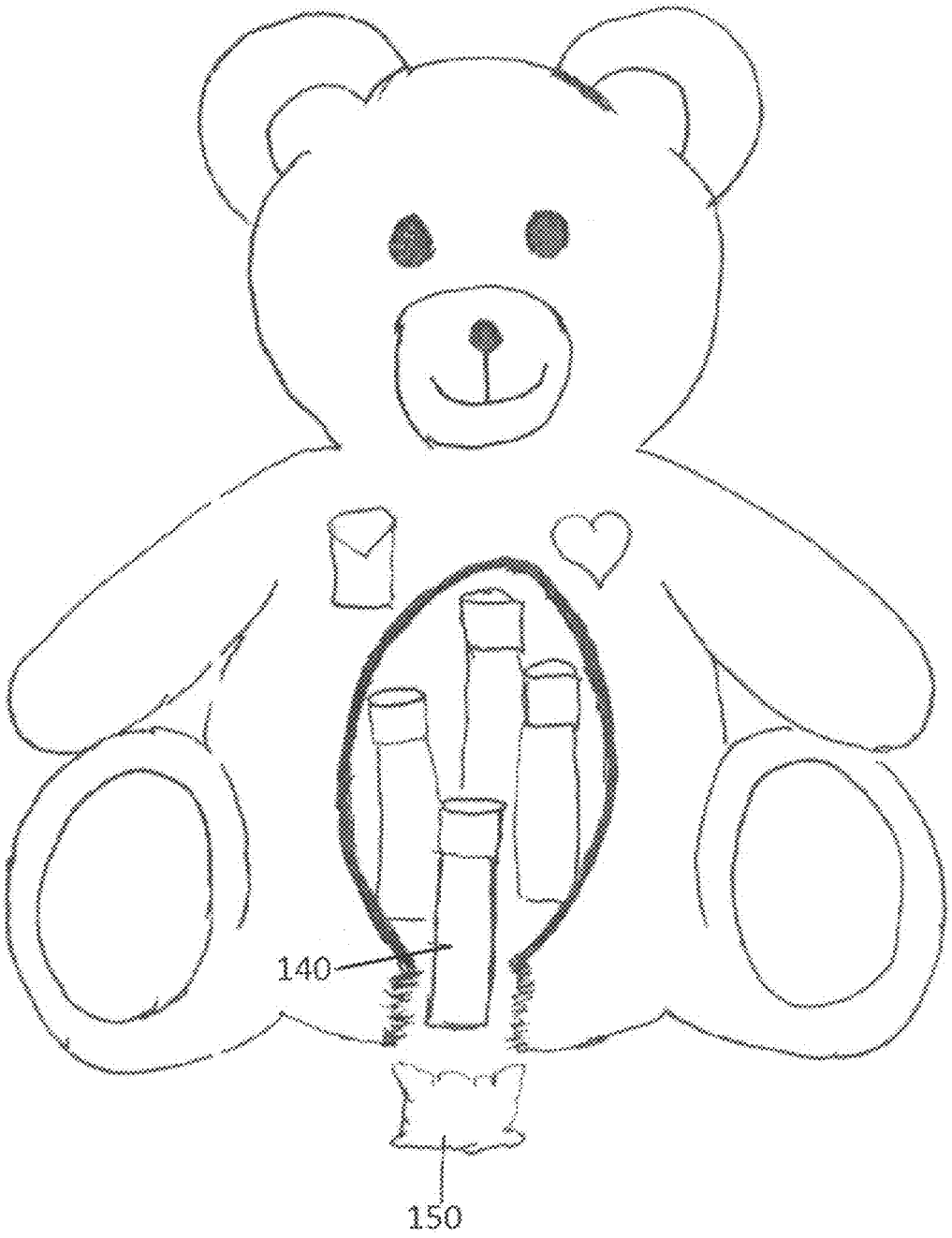
FIG. 4 shows how once the urns are placed in the device, a pillow is covering the urns, to make sure that padding is all the way around the device.

FIG. 3 illustrates how one or more urns can be placed inside the central cavity 135 contained by the fabric material 130 that forms the inner area. The urns such as 140 are placed into the animal as shown in FIG. 3. Once the urns are placed in as shown in FIG. 3, the pillow material 150 is placed under the urn, to close off the opening as shown in FIG. 4.

Figure 5:
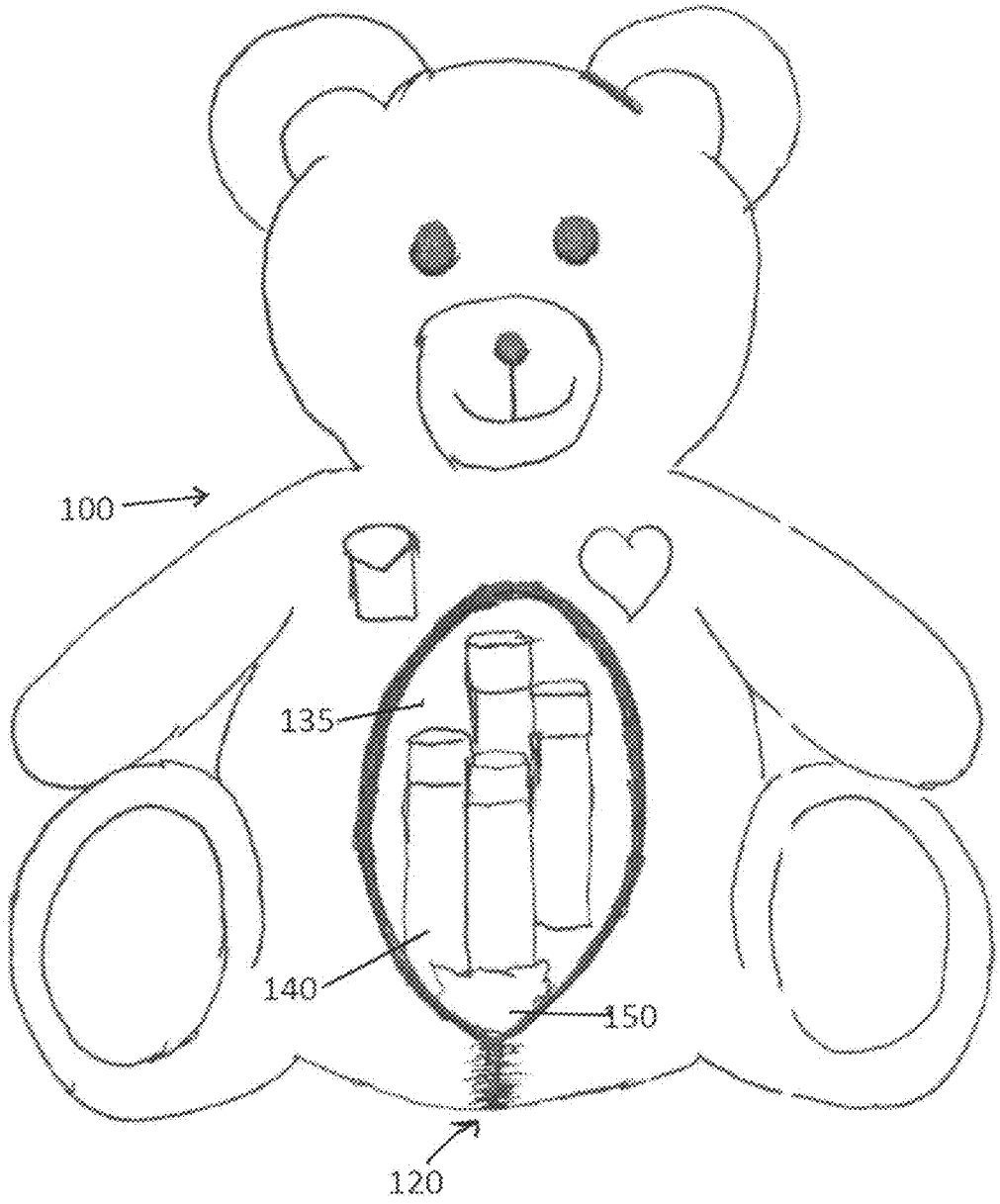
FIG. 5 shows the urn holding device stuffed animal with the urns therein closed, showing padding all around all parts of the device, from the front view.

FIG. 5 illustrates the closed animal including the urns such as 140 therein, and the central inner pocket 135 containing all the urns. The bottom portion of the stuffed animal 120 is illustrated as closed, e.g. by a zipper or by Velcro, hooks, fasteners, or any other mechanism.

Figure 6:
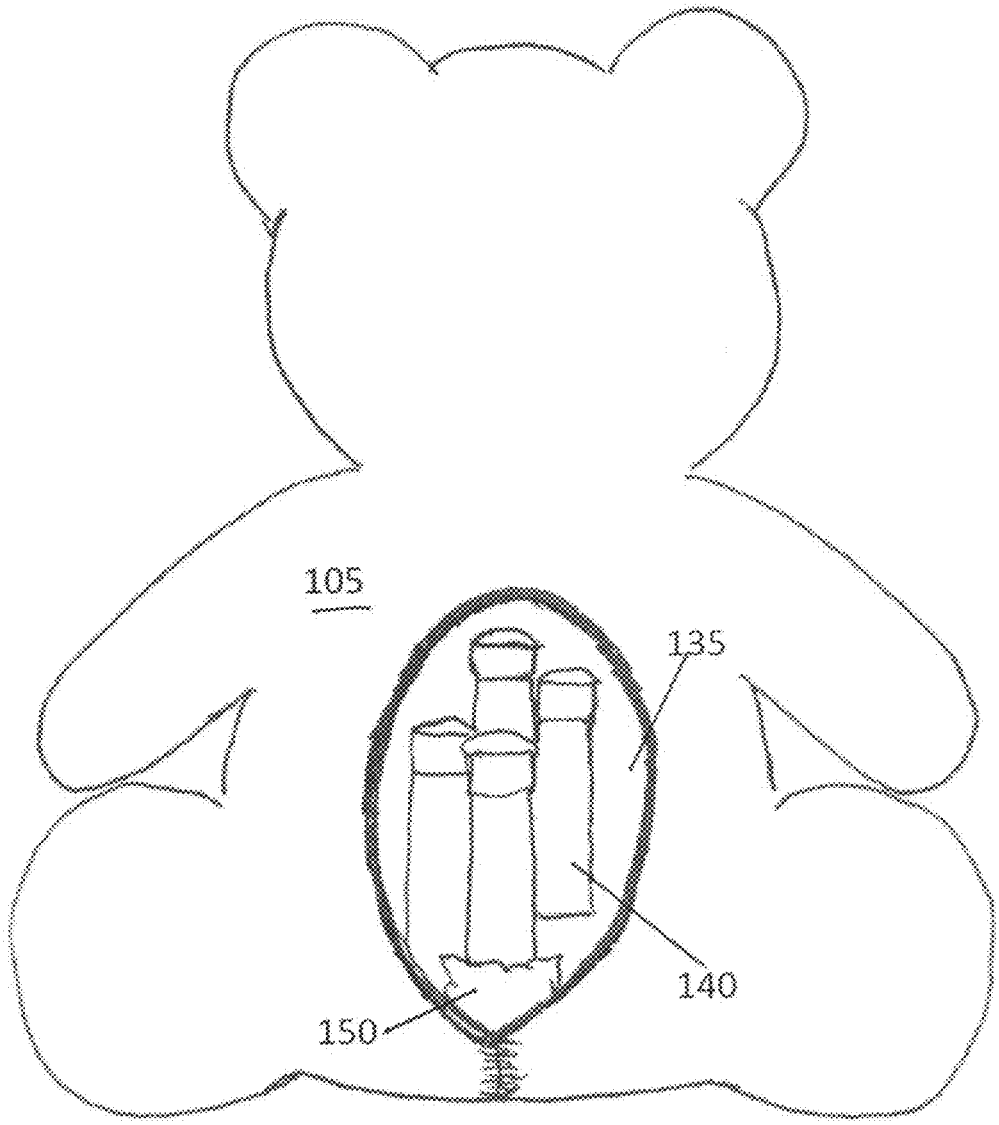
FIG. 6 shows the urn holding device from the rear.

FIG. 6 illustrates this from the rear, again showing the pillow. In all the embodiments, the urns such as 140 are placed in the interior cavity of the stuffed animal and its stuffing of the plush toy such as 105 separates each of the urns from all the sides. There is stuffing between the urn cavity 135 on all the sides including both arms, both legs, stomach, back and head. The bottom of the animal is where the stuffed animal is separated from the bottom of the device by the pillow 150.

Figure 7A:
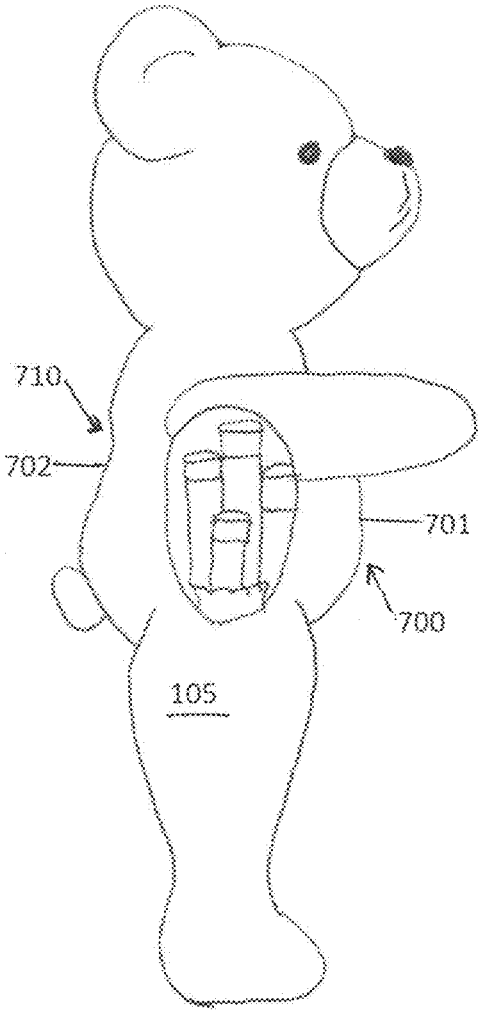
FIGS. 7A and 7B show side views of the urn holding device.
Figure 7B:
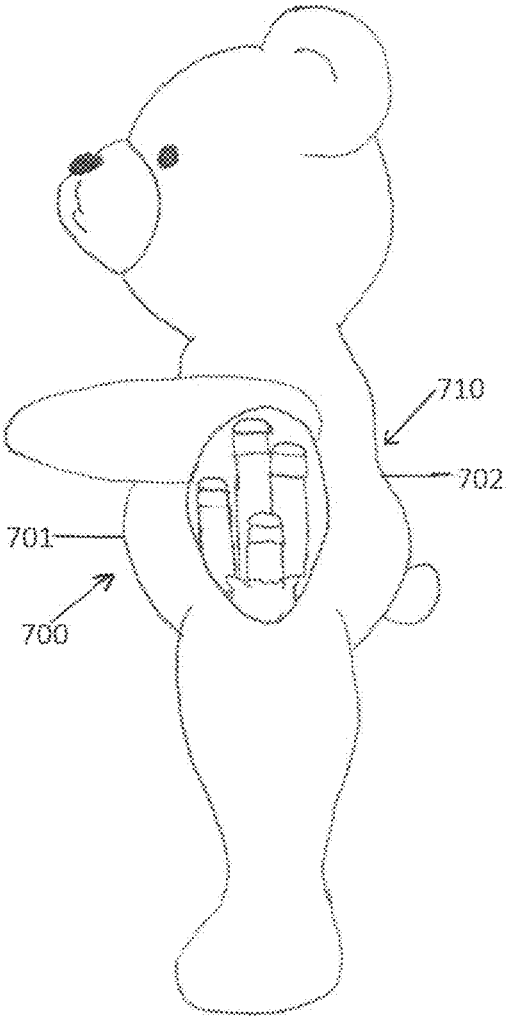

FIGS. 7A and 7B show this from the side, showing the stuffing surrounding the urn cavity.

The plush material may include synthetic fiber batting, cotton, straw, wood wool, plastic pellets or beans, but is preferably a plush material.

The body may comprise a resilient or collapsible material. Fabric is illustrated in the showing an exemplary embodiment. An exterior surface of the body may be covered in soft material such a fake fur material, or any other material conventionally used in stuffed animals.

In an alternative embodiment, the compartment has a switch disposed on its interior. The switch is activated by the existence of an object placed therein. For example, an urn is placed within the compartment and the urn closes a circuit, electrically connected to a visual indicator 160, which is provided visible on the outside of the body. The visual indicator 160 may be a light or some other device providing visible indication and confirmation of objects being contained within the compartment.

The body may have a compartment 161 visible on the exterior surface of the body. The exterior compartment is substantially transparent and is either removably attached or permanently affixed to the exterior surface allowing for photographs or other visible material to be placed therein. An opening of the exterior container allows for insertion of pictures or the material a user wishes to have displayed.

In an alternative embodiment, the body of the device is manufactured to replicate the appearance of the deceased. For example, where the deceased is a pet such as a dog or cat, the exterior of the body is provided with colors, marking, size, and any other distinguishing features applicable to the specific pet. Also, where the deceased is a pet, a specific urn is provided. For example, where the pet is a dog, the specific urn would comprise a container having a hollow interior with an elongated section separating two pairs of bulbous terminal ends, representing a bone.

In another embodiment, the exterior of the body is designed to meet personal needs or desires of the user. Where the user requires specific colors, patterns, or shapes, the exterior surface of the body is customizable to address the desired aesthetic features. For example, where a military style is required, the material can be patriotic or military themed to further illustrate the person being symbolically represented by the urn holder device. Further, the body may be defined as an accessory or garment worn by a user, wherein a smaller container holding the ashes, relic, or keepsake relating to the deceased loved one is placed therein. For example, the body is defined by a scarf having a small sealable opening whereby the container is disposed within an interior of the scarf and the scarf is worn by the user.

In a further embodiment, the device body accepts attachment or adornments whereby objects such as a patch or other visual element can be releasably attached to the body. For example, the body has a section or portion of hook and loop material, wherein the body has a hook portion and the attachment or adornment has a corresponding loop portion creating a releasable engagement between the two. In another example, the attachment or adornments is permanently affixed to the body, i.e. sewn onto the body exterior.

In use and in a preferred embodiment for the invention of the place holder and space within a toy to hold an Urn (or belongings of a loved one), the user will insert the Urn through the opening of the toy, and position the Urn in the place holder and space created specifically for the Urn or a loved ones belongings. The user then closes the opening after placing the plush pillow at bottom of opening before closing. The urn or urns are then completely surrounded by a plush material on all sides, top and bottom. The user has the option to place a picture of their lost loved one in the clear pocket made on the toy. The user has an additional option to turn on the blinking lighted heart at any time. The premise of the invented place holder and space in the toy is to allow the user to hug the toy carrying the ashes of their loved one or belongings, in hopes that it will bring some comfort knowing that they are hugging a toy with their ashes or belongings.

The invention has been described herein using specific embodiments for the purposes of illustration only. It will be readily apparent to one of ordinary skill in the art, however, that the principles of the invention can be embodied in other ways. Therefore, the invention should not be regarded as being limited in scope to the specific embodiments disclosed herein, but instead as being fully commensurate in scope with the following claims.

What is claimed is:

1. An urn holding stuffed animal device for storing cremated remains comprising:

a stuffed animal, having a body filled with a plush filling, and the stuffed animal having a head at a top of the stuffed animal, and a bottom area, an interior cavity opening from the bottom area of the stuffed animal, forming an opening into an interior of the stuffed animal, where the interior cavity is lined with material forming holding surfaces for a hard cased urn to be inserted into the interior cavity, and where all sides of the interior cavity lined with the material are surrounded at an exterior thereof by said plush fillies;

wherein said interior cavity is formed along a central axis of the stuffed animal;

a closure mechanism, located at the bottom area and substantially along said central axis, operating for opening and closing the interior cavity;

a plush pillow sized to fit between said opening in said interior cavity and said closure mechanism such that said plush pillow is located substantially along said central axis, where the plush pillow separates said closure mechanism from the urn inserted in the interior cavity; and the hard cased urn for storing the cremated remains, fitting in said interior cavity, and surrounded at all sides via said plush filling and said plush pillow, such that no surface of the hard cased urn can be felt from outside the stuffed animal.

2. The device of claim 1, wherein the body further comprises arms extending outward from the body at a central area of the body, and legs extending outward from the body adjacent the bottom area of the body.

3. The device of claim 2, wherein the urn is formed of metal.

4. The device of claim 2, wherein the urn having ash therein.

5. The device of claim 1, wherein the stuffed animal is a stuffed bear.

6. The device of claim 1, wherein the closure mechanism is a zipper.

7. The device of claim 1, further comprising a visual indicator attached to an outside surface of the stuffed animal.

8. The device of claim 1, wherein the stuffed animal is an animal from the group consisting of a bear, dog or cat.

* * * * *